US009320380B2

(12) United States Patent
Bronovicki et al.

(10) Patent No.: US 9,320,380 B2
(45) Date of Patent: Apr. 26, 2016

(54) CUBICLE CURTAIN LOADING SYSTEM AND METHOD

(71) Applicants: Dave Bronovicki, Piscataway, NJ (US); Eric Keith Wiedman, Matawan, NJ (US); Scott Oliveira, Kearny, NJ (US); Russell Geist, Brick, NJ (US); Janine Hildebrandt, South Plainfield, NJ (US); Mark Grace, Alpharetta, GA (US)

(72) Inventors: Dave Bronovicki, Piscataway, NJ (US); Eric Keith Wiedman, Matawan, NJ (US); Scott Oliveira, Kearny, NJ (US); Russell Geist, Brick, NJ (US); Janine Hildebrandt, South Plainfield, NJ (US); Mark Grace, Alpharetta, GA (US)

(73) Assignee: EMEH, Inc., Lebanon, NJ (US)

( * ) Notice: Subject to any disclaimer, the term of this patent is extended or adjusted under 35 U.S.C. 154(b) by 3 days.

(21) Appl. No.: 14/312,904

(22) Filed: Jun. 24, 2014

(65) Prior Publication Data

US 2015/0368963 A1 Dec. 24, 2015

(51) Int. Cl.

| | |
|---|---|
| ***A47H 15/00*** | (2006.01) |
| ***A47H 13/00*** | (2006.01) |
| *A61G 12/00* | (2006.01) |

(52) U.S. Cl.

CPC ..... *A47H 13/00* (2013.01); *A47H 2015/005* (2013.01); *A61G 12/00* (2013.01)

(58) Field of Classification Search

USPC ..... 160/350, 336
IPC ..... A47H 2015/005
See application file for complete search history.

(56) References Cited

U.S. PATENT DOCUMENTS

| | | | | | |
|---|---|---|---|---|---|
| 3,396,834 | A * | 8/1968 | Luckey | A47H 13/00 | 206/326 |
| 3,587,131 | A * | 6/1971 | Graf | A47H 13/00 | 16/95 D |
| 3,600,741 | A * | 8/1971 | Bays | A47H 13/00 | 16/87.8 |
| 3,913,204 | A * | 10/1975 | Finkbeiner | A47H 1/04 | 29/241 |
| 4,139,101 | A * | 2/1979 | Towfigh | A47G 5/00 | 160/336 |
| 4,153,969 | A * | 5/1979 | Mergenthaler | A47H 13/00 | 16/87 R |
| 5,518,058 | A * | 5/1996 | Gastmann | A47H 13/00 | 16/87.6 R |
| 8,533,911 | B2 * | 9/2013 | Lehrkamp | A47H 7/02 | 16/94 D |

FOREIGN PATENT DOCUMENTS

| | | | | |
|---|---|---|---|---|
| GB | 2215987 A | * | 10/1989 | A47H 13/00 |
| GB | 2334432 A | * | 8/1999 | A47H 13/00 |
| TR | WO 0154548 A1 | * | 8/2001 | A47H 7/02 |

* cited by examiner

*Primary Examiner* — David Purol
(74) *Attorney, Agent, or Firm* — Lawrence A. Baratta, Jr.; Christopher L. Bernard; Clements Bernard PLLC

(57) ABSTRACT

A cubicle curtain loading system, including: a first member having proximal and distal ends and configured to selectively retain a cubicle curtain, wherein the distal end of the first member is configured to engage a track system configured to selectively hold the cubicle curtain; and a second member having proximal and distal ends and disposed at an angle to the first member, wherein the distal end of the second member is coupled to the proximal end of the first member. The first member includes a slot traversing its length along a bottom or side surface thereof. Retainer structures coupled to the cubicle curtain selectively engage the slot and are gathered along the length of the first member. Alternatively, no slot is used and retainer structures coupled to the cubicle curtain are selectively disposed about the first member and are gathered along its length. One or more of the first member and the second member removably engage one or more clips coupled to one or more of a wall and a ceiling of a structure. Alternatively, the second member slidably engages a guide member coupled to a wall of a structure. The first member, the second member, and/or the track system may be integrally formed.

16 Claims, 9 Drawing Sheets

CUBICLE CURTAIN LOADING SYSTEM AND METHOD

FIELD OF THE INVENTION

The present invention relates generally to a cubicle curtain loading system and method. More specifically, the present invention relates to a cubicle curtain loading system that may be used with or incorporated into a conventional cubicle curtain track system, thereby making the loading/unloading of a curtain onto/from the cubicle curtain track system easier and more efficient.

BACKGROUND OF THE INVENTION

Drawable cubicle curtains are commonly used in healthcare and other facilities to surround an area and provide privacy. Typically, cubicle curtains are hung from/on a track system using a plurality of knobbed hangers or rings that slide in/over the track system. Often these cubicle curtains become dirty or soiled and must be removed, cleaned, and replaced. This can be difficult, as the cubicle curtains are typically hung from or near the ceiling of the facility. A variety of conventional tools, such as elongated hooks and the like, exist for hanging/removing cubicle curtains, but most are clumsy and may be readily misplaced.

Thus, what is still needed in the art is an improved cubicle curtain loading system that may be used with or incorporated into a conventional cubicle curtain track system, thereby making the making the loading/unloading of a curtain onto/from the cubicle curtain track system easier and more efficient such that it may be done with a desired frequency, daily, when patients are discharged, etc.

BRIEF SUMMARY OF THE INVENTION

Accordingly, in various exemplary embodiments, the present invention provides an improved cubicle curtain loading system and method that may be used with or incorporated into a conventional cubicle curtain track system, thereby making the making the loading/unloading of a curtain onto/from the cubicle curtain track system easier and more efficient. Advantageously, this cubicle curtain loading system is relatively inexpensive and is not readily misplaced.

In one exemplary embodiment, the present invention provides a cubicle curtain loading system, including: a first member having a proximal end and a distal end and configured to selectively retain a cubicle curtain, wherein the distal end of the first member is configured to engage a track system configured to selectively hold the cubicle curtain; and a second member having a proximal end and a distal end and disposed at an angle to the first member, wherein the distal end of the second member is coupled to the proximal end of the first member. Preferably, the first member and the second member are manufactured from one of a rigid plastic material and a rigid metallic material. Optionally, the first member and the second member are substantially hollow. The first member includes a slot traversing its length along one of a bottom surface and a side surface thereof. A plurality of retainer structures coupled to the cubicle curtain selectively engage the slot and are gathered along the length of the first member. Alternatively, no slot is used and a plurality of retainer structures coupled to the cubicle curtain are selectively disposed about the first member and are gathered along its length. Preferably, the distal end of the first member is selectively disposed adjacent to an end of the track system. Optionally, the distal end of the first member is selectively disposed one of about and within an end of the track system. The second member may be coupled to the first member at a substantially 90-degree angle. The second member may be coupled to the first member using a support member. Optionally, the second member includes a handle portion. One or more of the first member and the second member removably engage one or more clips coupled to one or more of a wall and a ceiling of a structure. Alternatively, the second member slidably engages a guide member coupled to a wall or floor of a structure. Optionally, the cubicle curtain loading system also includes a motor operable for sliding the second member with respect to the guide member. Optionally, the second member includes one or more hinged portions. Optionally, two or more of the first member, the second member, and the track system are integrally formed.

In another exemplary embodiment, the present invention provides a cubicle curtain loading method, including: loading a cubicle curtain onto a cubicle curtain loading system; disposing a portion of the cubicle curtain loading system adjacent to a track system configured to hold the cubicle curtain; and sliding the cubicle curtain from the cubicle curtain loading system to the track system; wherein the cubicle curtain loading system removably engages one or more clips coupled to one or more of a wall and a ceiling of a structure. The cubicle curtain loading system includes: a first member including a proximal end and a distal end and configured to selectively retain the cubicle curtain, wherein the distal end of the first member is configured to engage the track system configured to selectively hold the cubicle curtain; and a second member including a proximal end and a distal end and disposed at an angle to the first member, wherein the distal end of the second member is coupled to the proximal end of the first member. The first member includes a slot traversing its length along one of a bottom surface and a side surface thereof. A plurality of retainer structures coupled to the cubicle curtain selectively engage the slot and are gathered along the length of the first member. Alternatively, no slot is used and a plurality of retainer structures coupled to the cubicle curtain are selectively disposed about the first member and are gathered along its length. The distal end of the first member is selectively disposed adjacent to an end of the track system. Optionally, the distal end of the first member is selectively disposed one of about and within an end of the track system. Preferably, the second member is coupled to the first member at a substantially 90-degree angle. Optionally, two or more of the first member, the second member, and the track system are integrally formed.

In a further exemplary embodiment, the present invention provides a cubicle curtain loading method, including: loading a cubicle curtain onto a cubicle curtain loading system; disposing a portion of the cubicle curtain loading system adjacent to a track system configured to hold the cubicle curtain; and sliding the cubicle curtain from the cubicle curtain loading system to the track system; wherein the cubicle curtain loading system slidably engages a guide member coupled to a wall or floor of a structure. The cubicle curtain loading system includes: a first member including a proximal end and a distal end and configured to selectively retain the cubicle curtain, wherein the distal end of the first member is configured to engage the track system configured to selectively hold the cubicle curtain; and a second member including a proximal end and a distal end and disposed at an angle to the first member, wherein the distal end of the second member is coupled to the proximal end of the first member. The first member includes a slot traversing its length along one of a bottom surface and a side surface thereof. A plurality of retainer structures coupled to the cubicle curtain selectively engage the slot and are gathered along the length of the first member. Alternatively, no slot is used and a plurality of retainer structures coupled to the cubicle curtain are selectively disposed about the first member and are gathered along its length. The distal end of the first member is selectively disposed adjacent to an end of the track system. Optionally, the distal end of the first member is selectively disposed one of about and within an end of the track system. Preferably, the second member is coupled to the first member at a substantially 90-degree angle. Optionally, two or more of the first member, the second member, and the track system are integrally formed. Optionally, the cubicle curtain loading system also includes a motor operable for sliding the second member with respect to the guide member.

In a still further exemplary embodiment, the present invention provides a cubicle curtain loading system, including: a first connector configured to selectively support a cubicle curtain, wherein the first connector is configured to engage a portion of a track system configured to selectively retain the cubicle curtain; and a second member having a proximal end and a distal end, wherein the distal end of the second member is coupled to the first connector. The first connector is configured to selectively support the cubicle curtain through the portion of the track system engaged by the first connector. The first connector and the second member are manufactured from one of a plastic material and a metallic material. Optionally, the second member is substantially hollow. The second member includes a telescoping portion including a floor engaging portion. The telescoping portion is telescoped from the second member via a motor. Alternatively, the telescoping portion is telescoped from the second member via a crank mechanism. The distal end of the second member also includes a ceiling-engaging portion. Alternatively, the first connector is selectively translated along the second member.

BRIEF DESCRIPTION OF THE DRAWINGS

The present invention is illustrated and described herein with reference to the various drawings, in which like reference numbers are used to denote like system components/method steps, as appropriate, and in which.

DETAILED DESCRIPTION OF THE INVENTION

Figure 1:
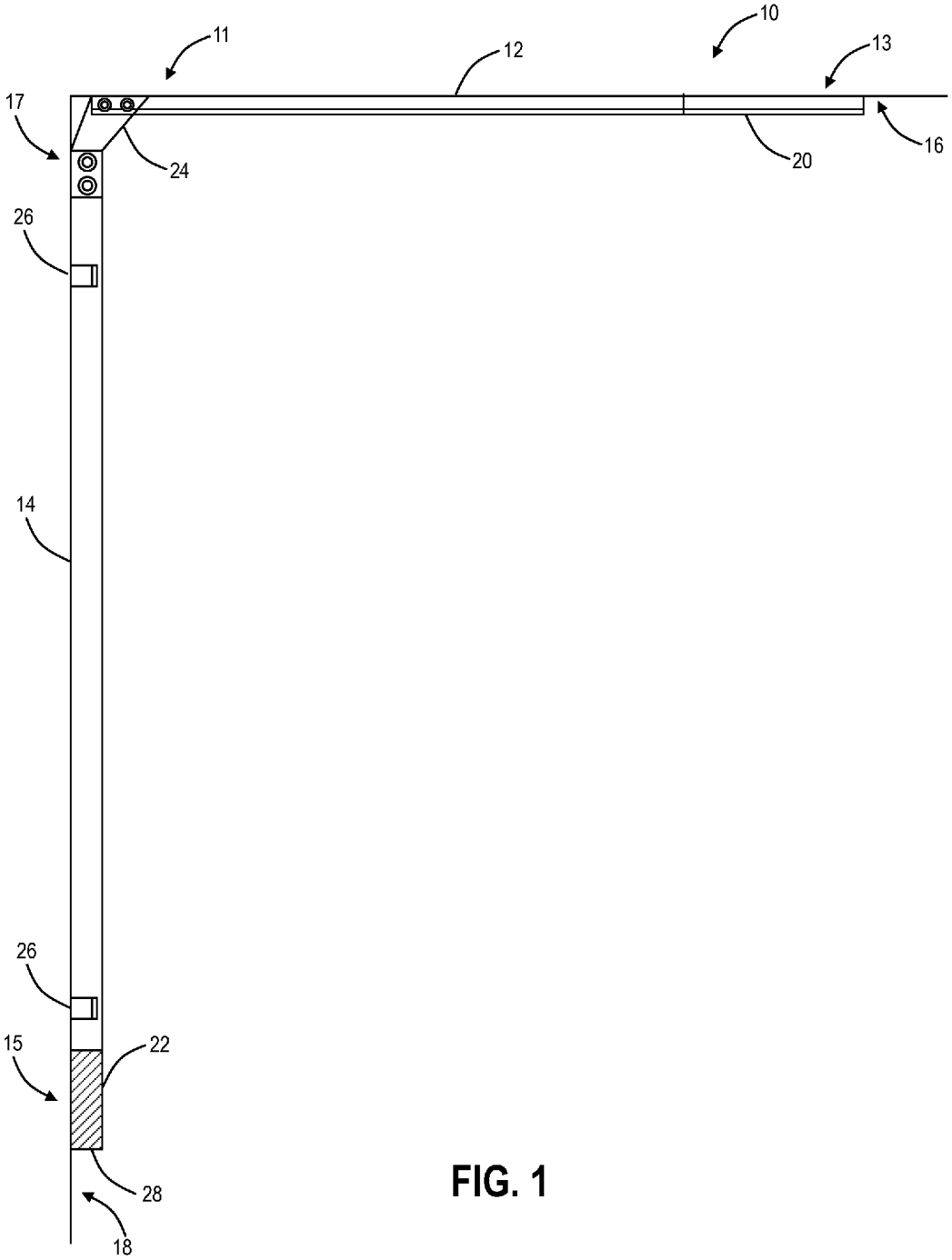
FIG. 1 is a planar side view of one exemplary embodiment of the cubicle curtain loading system of the present invention; specifically a cubicle curtain loading system designed to be used with a ceiling or near-ceiling-mounted track system.

Referring now specifically to FIG. 1, in one exemplary embodiment, the present invention provides a cubicle curtain loading system 10 that includes a first member 12 having a proximal end 11 and a distal end 13. The first member 12 is configured to selectively and "temporarily" retain a cubicle curtain in a "hung" configuration. The first member 12 consists of a substantially hollow structure having a slot running along its bottom or side surface in which a plurality of knobbed hangers or the like coupled to the cubicle curtain are partially disposed. Alternatively, the first member 12 consists of one or more substantially hollow or solid structure(s) around which a plurality of rings or the like coupled to the cubicle curtain are disposed. It will be readily apparent to those of ordinary skill in the art that the first member 12 may consist of any structure in/on which the cubicle curtain hangers, rings, or the like can be temporarily "hung" while the cubicle curtain is "hung" on/removed from the conventional track system 20. Typically, the track system 20 is disposed on or near the ceiling 16 of a structure, on a wall 18 in the latter case. The distal end 13 of the first member 12 is configured to engage the track system 20, which is configured to "permanently" hold the cubicle curtain.

The first member 12 engages the track system 20 by being raised into position and mating with it, either in an end-to-end fashion, by passing into or through a portion of the track system 20, etc. All such configurations are contemplated herein, provided that the first member 12 on which the cubicle curtain is "temporarily" "hung" selectively mates with the track system 20 when it is raised into position such that the cubicle curtain may be slid off of/onto the first member 12 onto/off of the track system 20. As such, any portion of the first member 12 or the second member 14 may be integrally formed with or otherwise coupled to the track system 20.

The cubicle curtain loading system 10 also includes a second member 14 having a proximal end 15 and a distal end 17. Preferably, the second member 14 is disposed at an angle to the first member 12, such as a 90-degree angle, for example. The distal end 17 of the second member 14 is coupled to the proximal end 11 of the first member 12 in the embodiment illustrated, although a central portion of the second member 14 could be coupled to the proximal end 11 of the first member 12 instead. Like the first member 12, the second member 14 may also consist of any kind and number of substantially hollow or solid structure(s). The second member 14 may further be assembled from a plurality of pieces. In operation, the second member 14 is disposed at or near the wall 18 of the structure, as is described in greater detail herein. The second member 14 may also be "permanently" affixed to the wall 18 of the structure, as is also described in greater detail herein. The second member 14 is designed to provide the user convenient ground-level access to actuate the first member 12 and raise/lower the cubicle curtain to/from the track system 20 above, such that the cubicle curtain can then be slid off of/onto the first member 12 onto/off of the track system 20.

Accordingly, the second member 14 may include a handle portion 22.

Preferably, the first member 12 and the second member 14 are, at least in part, manufactured from a rigid plastic material, a rigid metallic material, or the like. The first member 12 and the second member 14 are joined to one another via one or more support structures 24, nuts and bolts, screws, rivets, welds, and/or the like. This connection may be rigid, hinged, or pivotable.

Figure 2:
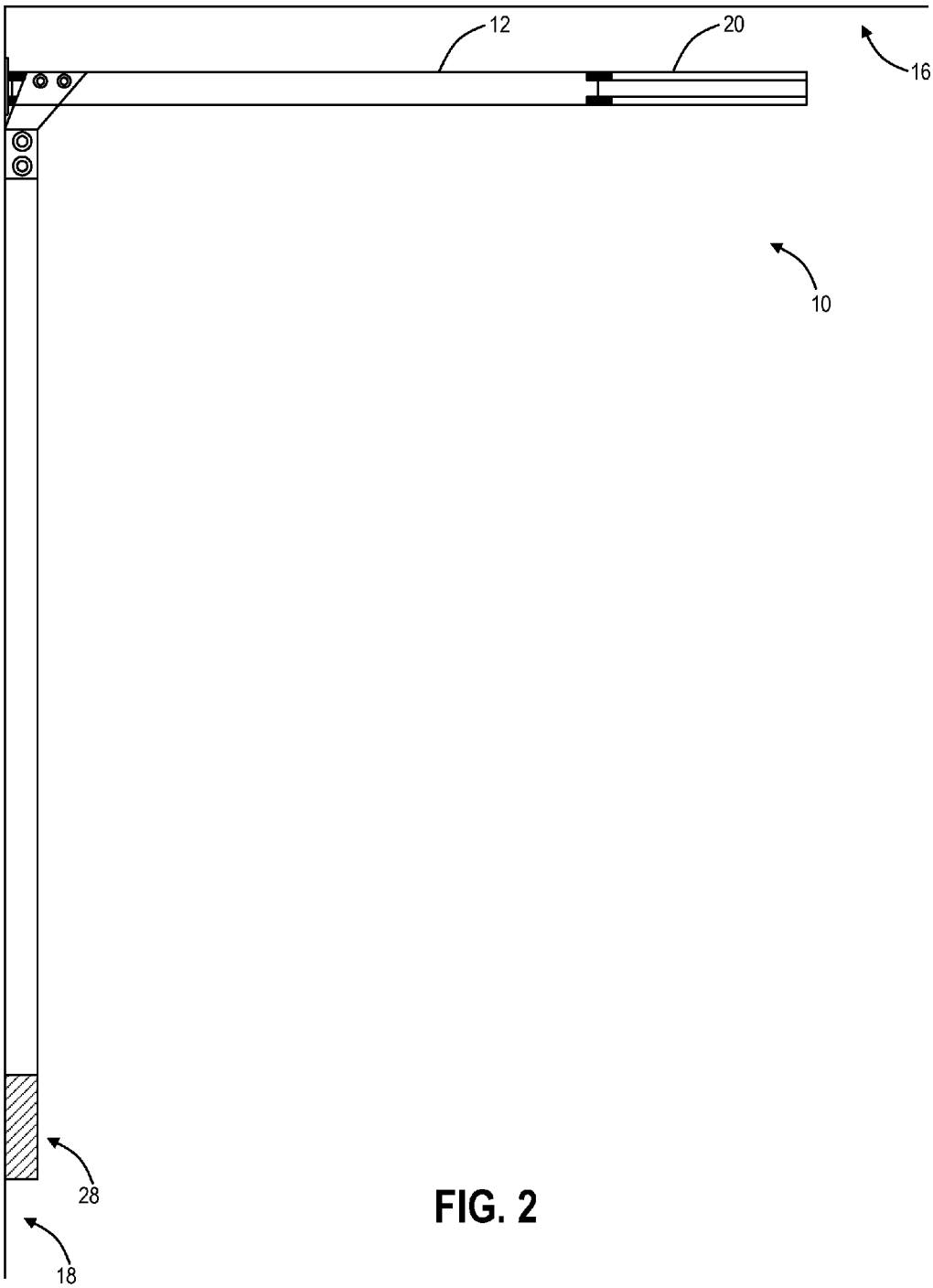
FIG. 2 is a planar side view of another exemplary embodiment of the cubicle curtain loading system of the present invention; specifically a cubicle curtain loading system designed to be used with a wall-mounted track system.

FIG. 2 illustrates an embodiment of the cubicle curtain loading system 10 that is suitable for use with a wall-mounted track system 20. In this configuration, the slot of the first member 12, if used, is disposed along the side surface of the first member 12, thereby mating with a slot, if used, disposed along a side of the track system 20.

In the "removable" embodiment of the cubicle curtain loading system 10 of FIGS. 1 and 2, one or more of the first member 12 and the second member 14 engage one or more clips 26 coupled to the ceiling 16 and/or wall 18 of the structure when the first member 12 is engaged with the track system 20. These clips 26 serve to hold the first member 12 and the second member 14 in place which the cubicle curtain is loaded/unloaded onto/from the first member 12. A supporting bracket 28 may also be used for this purpose.

Figure 3:
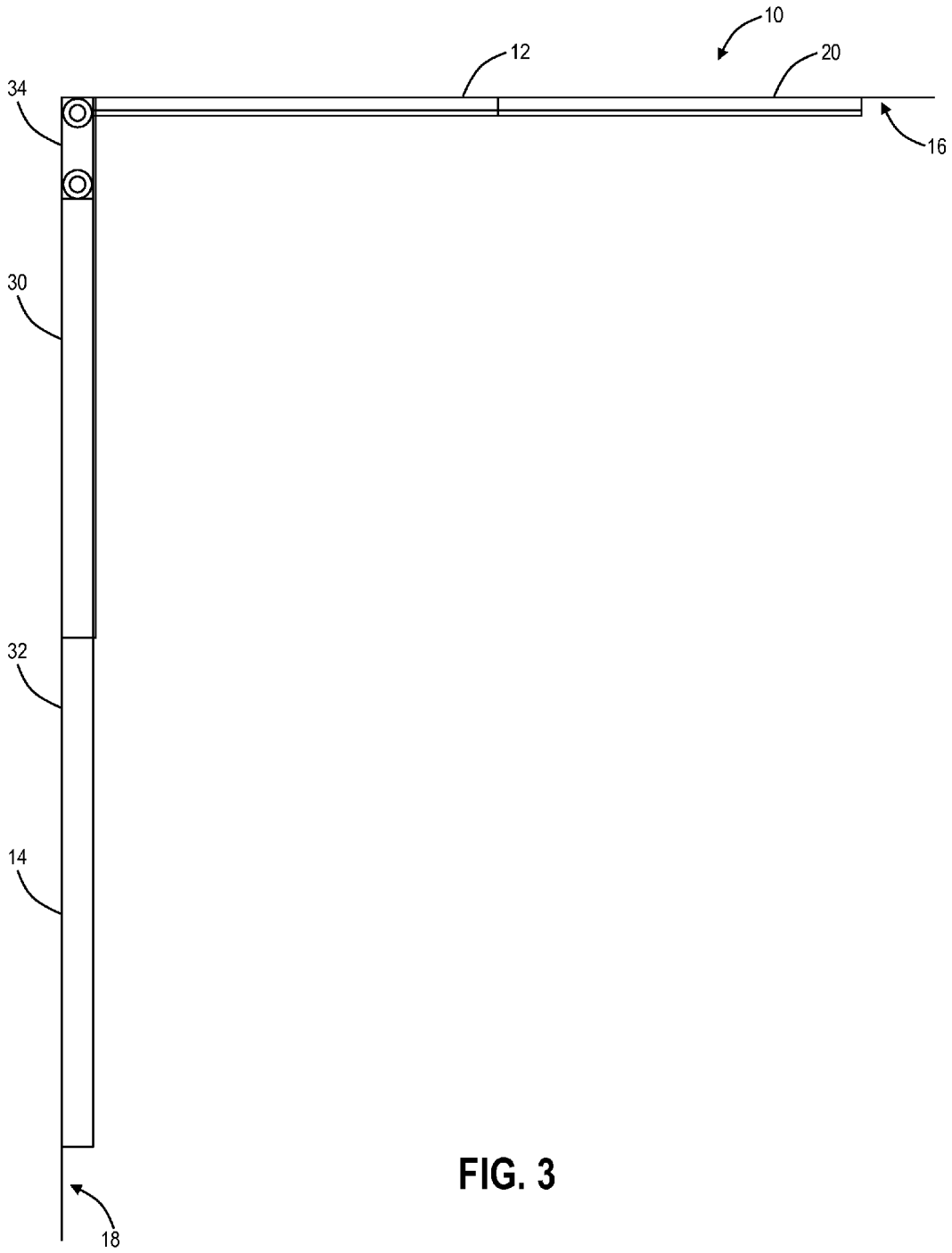
FIG. 3 is a planar side view of a further exemplary embodiment of the cubicle curtain loading system of the present invention; specifically a "permanent" cubicle curtain loading system affixed to the wall of a structure adjacent a track system.
Figure 4:
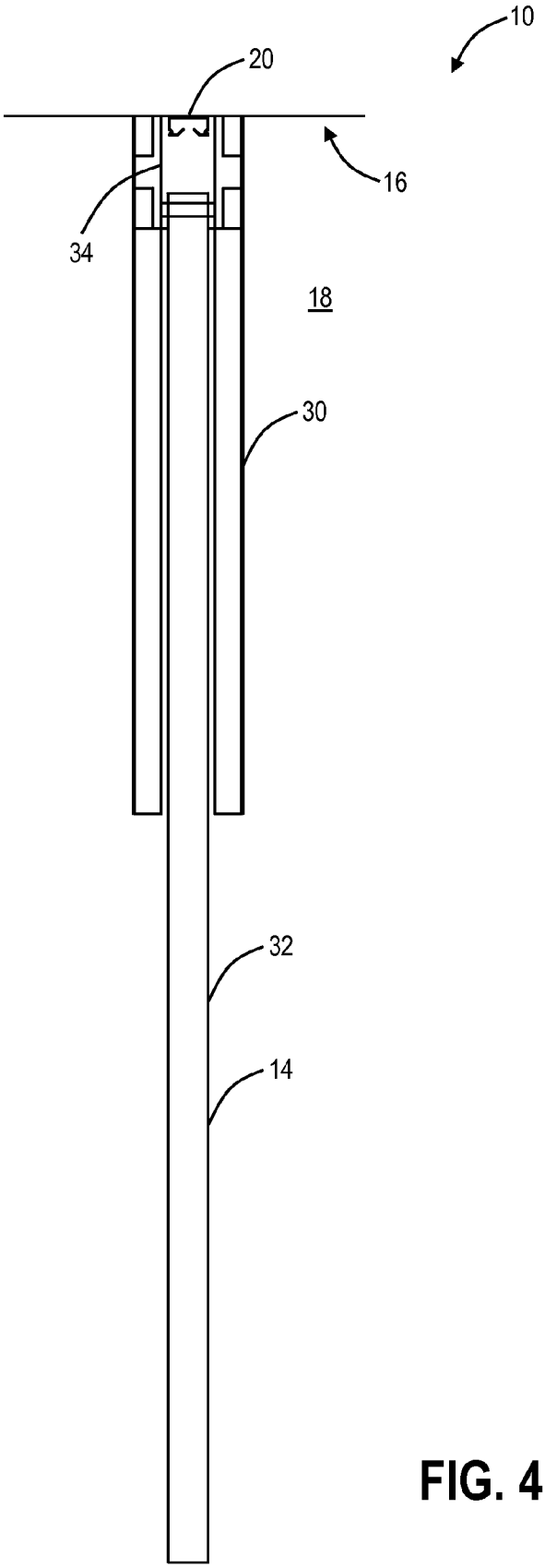
FIG. 4 is a planar end view of the cubicle curtain loading system of FIG. 3.

Referring now specifically to FIGS. 3 and 4, in a "permanent" embodiment of the cubicle curtain loading system 10, the second member 14 slidably engages a guide member 30 coupled to the wall 18 (or floor) of the structure. The second member 14 may be hingedly connected to the first member 12, or may include a handle portion 32 and a slider portion 34 that are hingedly connected, with the slider portion 34 being coupled to the guide member 30 and connected to the first member 12.

In this "permanent" embodiment of the cubicle curtain loading system 10, the second member 14 may be coupled to the guide member 30 via a plurality of wheels, slider pads, or the like that decrease friction and allow the second member 14 to slide smoothly with respect to the guide member 30. The second member 14 may also be coupled to a pulley mechanism, a crank mechanism, and/or a motor 40 (FIG. 5) that allow the second member to be mechanically/electrically actuated with respect to the guide member 30, such that the user does not have to manually raise/lower the cubicle curtain coupled to the first member 12.

Referring now to FIGS. 1-4, the present invention provides a cubicle curtain loading method that includes loading a cubicle curtain onto the cubicle curtain loading system 10, disposing a portion of the cubicle curtain loading system 10 adjacent to the track system 20 configured to hold the cubicle curtain; and sliding the cubicle curtain from the cubicle curtain loading system 10 to the track system 10, where the cubicle curtain loading system 10 removably engages one or more clips 26 coupled to one or more of the wall 18 and the ceiling 16 of the structure. Again, the cubicle curtain loading system 10 includes: the first member 12 including a proximal end 11 and a distal end 13, configured to selectively retain the cubicle curtain, where the distal end 13 of the first member 12 is configured to engage the track system 20 configured to selectively hold the cubicle curtain; and the second member 14 including a proximal end 15 and a distal end 17 and disposed at an angle to the first member 12, where the distal end 17 of the second member 14 is coupled to the proximal end 11 of the first member 12.

Referring again to FIGS. 1-4, the present invention provides a cubicle curtain loading method that includes loading a cubicle curtain onto a cubicle curtain loading system 10, disposing a portion of the cubicle curtain loading system 10 adjacent to a track system 20 configured to hold the cubicle curtain, and sliding the cubicle curtain from the cubicle curtain loading system 10 to the track system 20, where the cubicle curtain loading system 10 slidably engages a guide member 30 coupled to the wall 18 (or floor) of the structure. Again, the cubicle curtain loading system 10 includes: the first member 12 including a proximal end 11 and a distal end 13, configured to selectively retain the cubicle curtain, where the distal end 13 of the first member 12 is configured to engage the track system 20 configured to selectively hold the cubicle curtain; and the second member 14 including a proximal end 15 and a distal end 17 and disposed at an angle to the first member 12, where the distal end 17 of the second member 14 is coupled to the proximal end 11 of the first member 12. Optionally, the cubicle curtain loading system 10 also includes a motor 40 (FIG. 5) operable for sliding the second member 14 with respect to the guide member 30.

Figure 5:
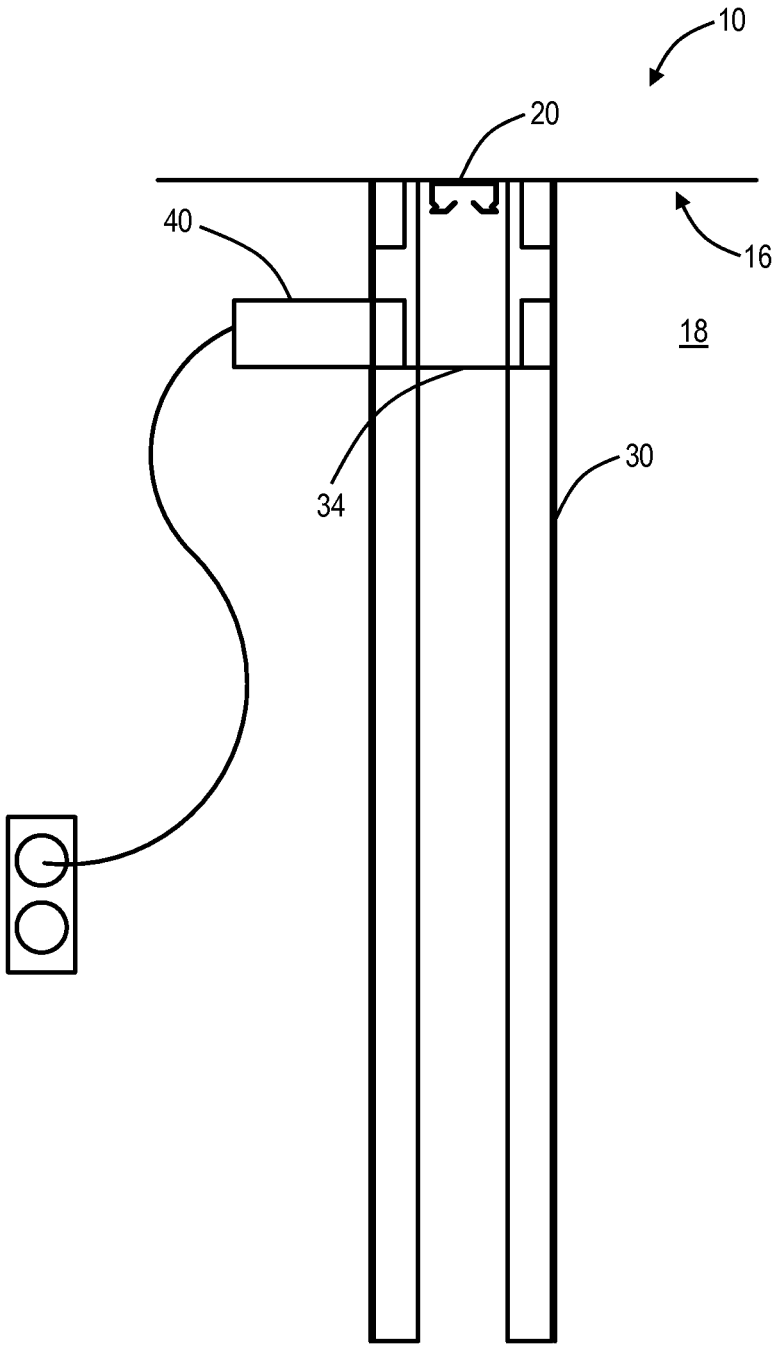
FIG. 5 is a planar end view of the cubicle curtain loading system of FIGS. 3 and 4, incorporating an optional motor (which may be used in all embodiments)
Figure 6:
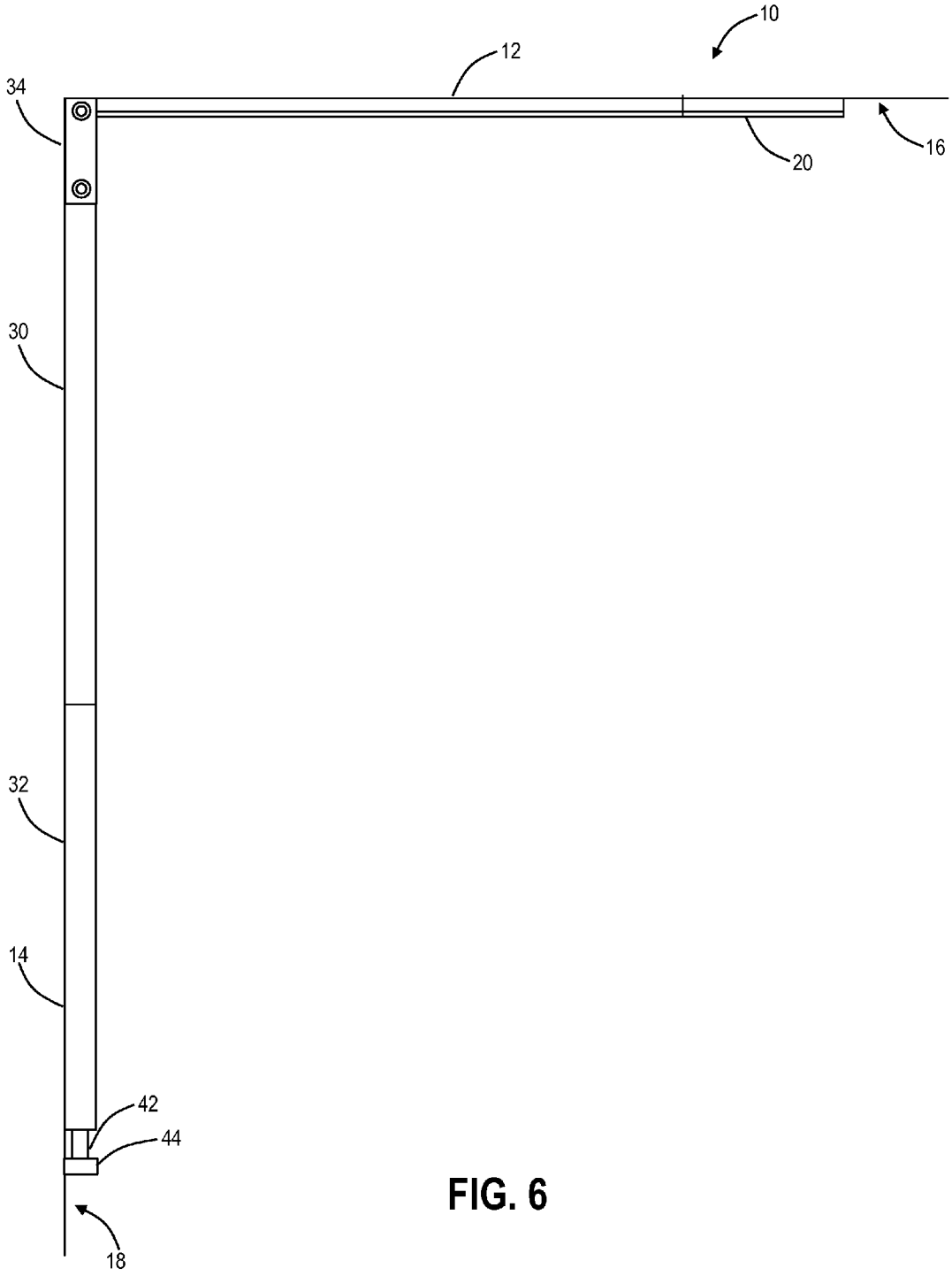
FIG. 6 is a planar side view of a still further exemplary embodiment of the cubicle curtain loading system of the present invention; specifically a "permanent" cubicle curtain loading system affixed to the wall of a structure adjacent a track system and including a telescoping and floor-engaging feature.
Figure 7:
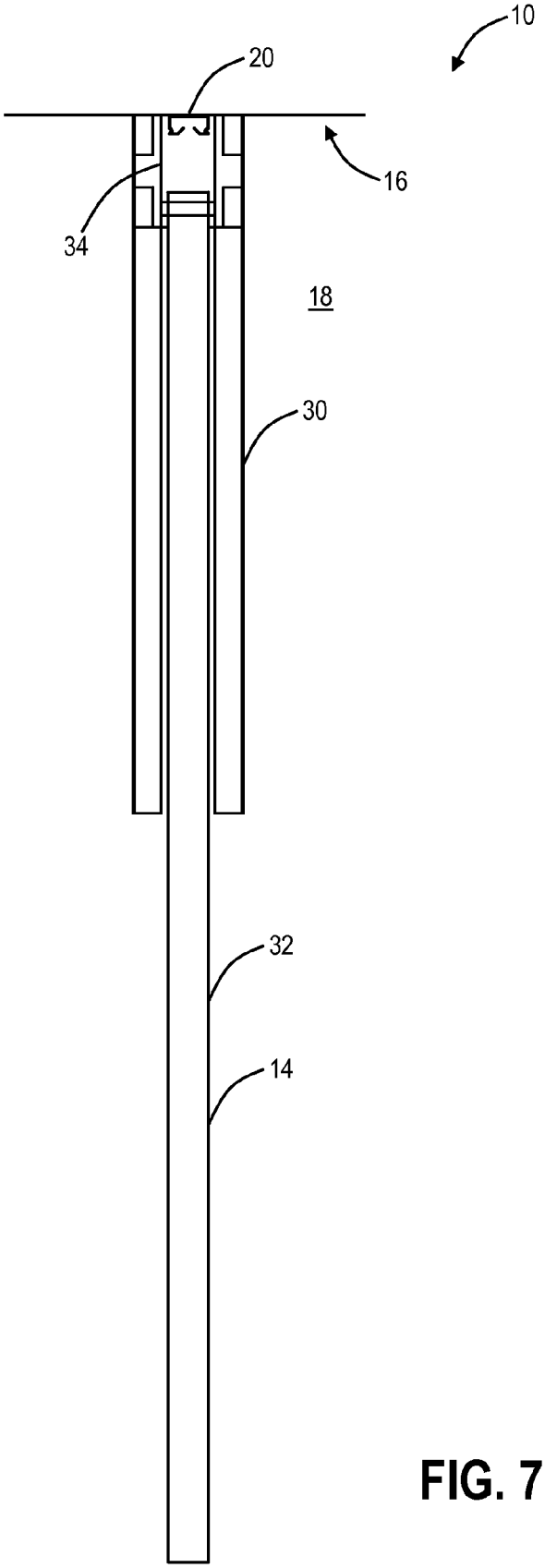
FIG. 7 is a planar end view of the cubicle curtain loading system of FIG. 6.

Referring now specifically to FIGS. 6 and 7, in any embodiment, the second member 14 may include a telescoping portion 42 including a floor-engaging portion 44 that are configured to selectively bias the second member 14 away from the floor, such that the first member 12 may be raised into or held in place. Accordingly, the telescoping portion 42 may be telescoped from the second member 14 manually, using a crank mechanism 46 (FIGS. 8 and 9), or using a motor (FIG. 5).

Figure 8:
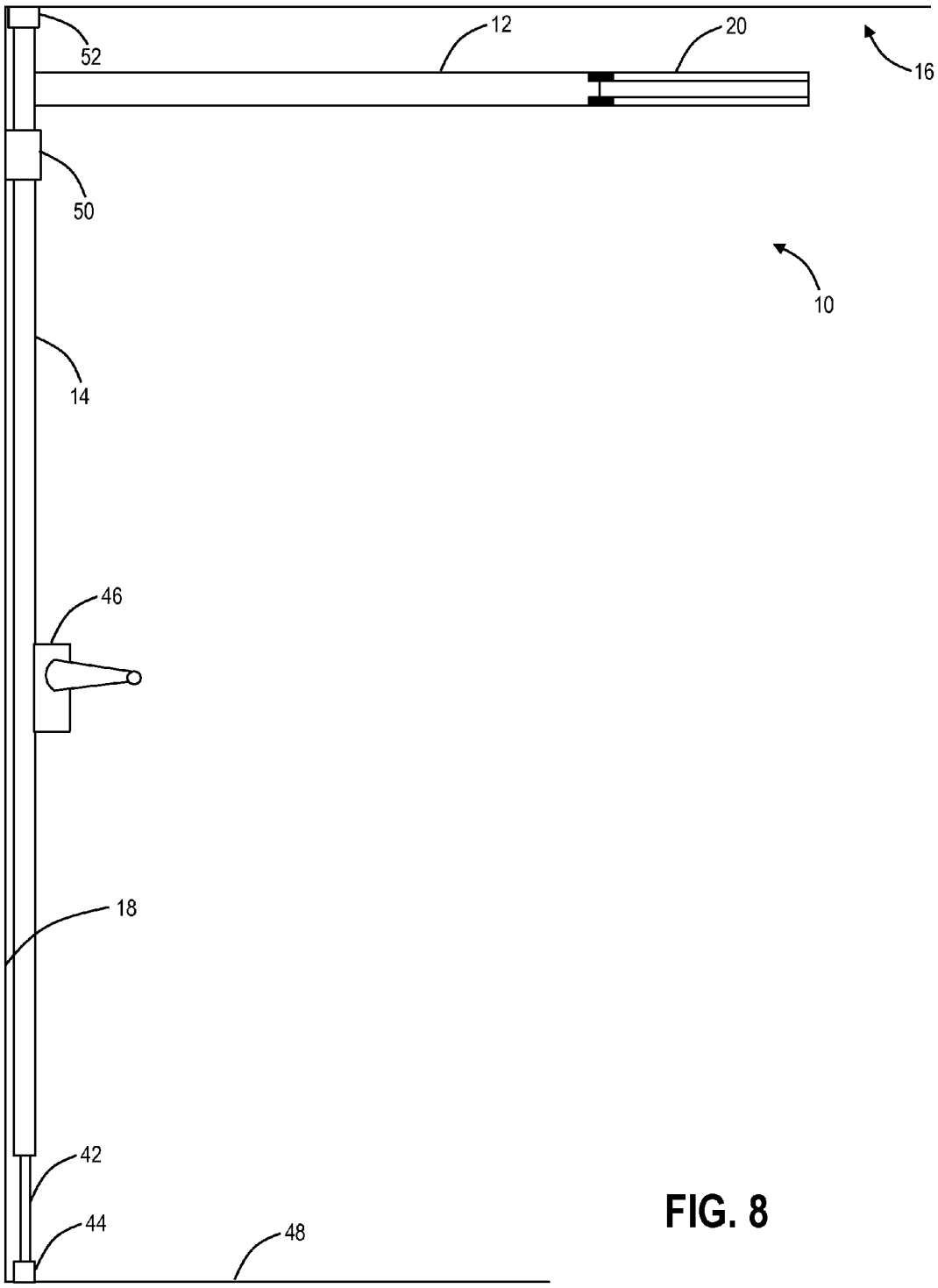
FIG. 8 is a planar side view of a still further exemplary embodiment of the cubicle curtain loading system of the present invention; specifically a "temporary" "wall-mounted" cubicle curtain loading system designed to be used with a ceiling or near-ceiling-mounted track system.
Figure 9:
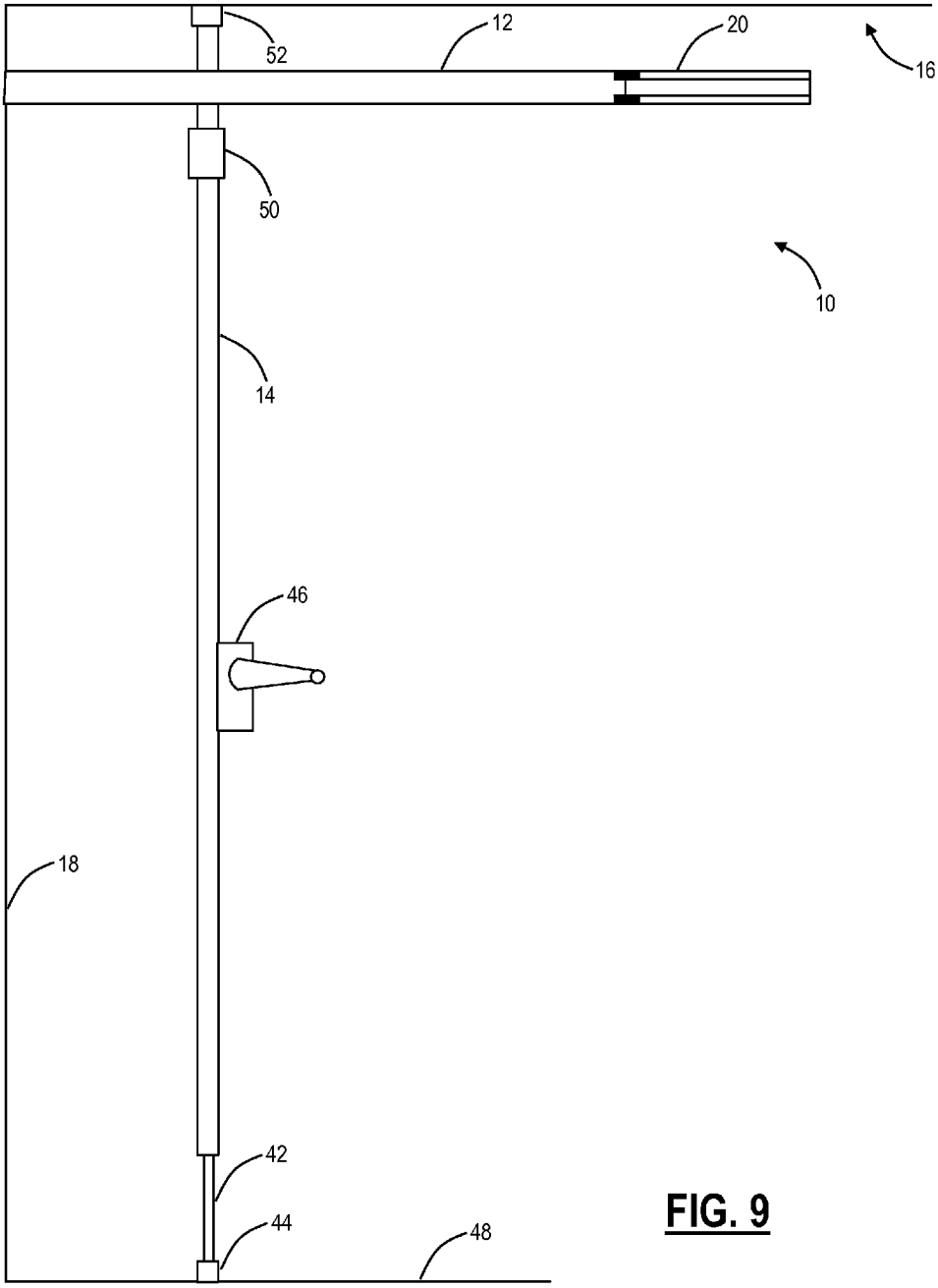
FIG. 9 is a planar side view of a still further exemplary embodiment of the cubicle curtain loading system of the present invention; specifically a "temporary" "free-standing" cubicle curtain loading system designed to be used with a ceiling or near-ceiling-mounted track system.

Referring now specifically to FIGS. 8 and 8, in a still further exemplary embodiment, the present invention provides a cubicle curtain loading system 10, including: a first connector 50 configured to selectively support a cubicle curtain, wherein the first connector 50 is configured to engage a portion 12 of a track system 20 configured to selectively retain the cubicle curtain; and a second member 14 having a proximal end and a distal end, wherein the distal end of the second member 14 is coupled to the first connector 50. The first connector 50 is configured to selectively support the cubicle curtain through the portion 12 of the track system 20 engaged by the first connector 50. The first connector 50 and the second member 14 are manufactured from one of a plastic material and a metallic material. Optionally, the second member 14 is substantially hollow. The second member 14 includes a telescoping portion 42 including a floor engaging portion 44. The telescoping portion 42 is telescoped from the second member 14 via a motor 40 (FIG. 5). Alternatively, the telescoping portion 42 is telescoped from the second member 14 via a crank mechanism 46. The distal end of the second member 14 also includes a ceiling-engaging portion 52. Alternatively, the first connector 50 is selectively translated along the second member 14.

Although the present invention is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A cubicle curtain loading system, comprising:

a first member comprising a proximal end and a distal end, wherein the first member retains a cubicle curtain, wherein the distal end of the first member engage and mate with a track system which holds the cubicle curtain; and a second member comprising a proximal end and a distal end and disposed at an angle to the first member, wherein the distal end of the second member is coupled to the proximal end of the first member, wherein the cubicle curtain is i) slideable off of the first member and onto the track system and ii) slideable off of the track system and onto the first member, and wherein the first member is moveable relative to the second member to raise and lower the first member for access to the cubicle curtain for hanging and removal thereof.

2. The cubicle curtain loading system of claim 1, wherein the first member and the second member are manufactured from one of a rigid plastic material and a rigid metallic material.

3. The cubicle curtain loading system of claim 1, wherein the first member and the second member are substantially hollow.

4. The cubicle curtain loading system of claim 1, wherein the first member comprises a slot traversing its length along one of a bottom surface and a side surface thereof.

5. The cubicle curtain loading system of claim 4, wherein a plurality of retainer structures coupled to the cubicle curtain engage the slot and are gathered along the length of the first member.

6. The cubicle curtain loading system of claim 1, wherein a plurality of retainer structures coupled to the cubicle curtain are disposed about the first member and are gathered along its length.

7. The cubicle curtain loading system of claim 1, wherein the distal end of the first member is disposed adjacent to an end of the track system.

8. The cubicle curtain loading system of claim 1, wherein the distal end of the first member is disposed one of about and within an end of the track system.

9. The cubicle curtain loading system of claim 1, wherein the second member is coupled to the first member at a 90-degree angle.

10. The cubicle curtain loading system of claim 1, wherein the second member is coupled to the first member using a support member.

11. The cubicle curtain loading system of claim 1, wherein the second member comprises a handle portion.

12. The cubicle curtain loading system of claim 1, wherein one or more of the first member and the second member removably engage one or more clips coupled to one or more of a wall and a ceiling of a structure.

13. The cubicle curtain loading system of claim 1, wherein the second member slidably engages a guide member coupled to a wall or floor of a structure.

14. The cubicle curtain loading system of claim 1, further comprising a motor operable for sliding the second member with respect to the guide member.

15. The cubicle curtain loading system of claim 1, wherein the second member comprises one or more hinged portions.

16. The cubicle curtain loading system of claim 1, wherein two or more of the first member, the second member, and the track system are integrally formed.

* * * * *